US007950667B2

(12) United States Patent
Shum

(10) Patent No.: US 7,950,667 B2
(45) Date of Patent: May 31, 2011

(54) TARGET APPARATUS

(75) Inventor: Michael Wing Haye Shum, Hong Kong SAR (CN)

(73) Assignee: Parkway Holdings Limited, Hong Kong SAR (CN)

( * ) Notice: Subject to any disclaimer, the term of this patent is extended or adjusted under 35 U.S.C. 154(b) by 9 days.

(21) Appl. No.: 12/399,144

(22) Filed: Mar. 6, 2009

(65) Prior Publication Data

US 2010/0225062 A1 Sep. 9, 2010

(51) Int. Cl.
*F41J 1/10* (2006.01)

(52) U.S. Cl. ..... 273/406; 273/407

(58) Field of Classification Search ..... 273/359, 273/366–371, 390–392, 403–410
See application file for complete search history.

(56) References Cited

U.S. PATENT DOCUMENTS

| | | | | |
|---|---|---|---|---|
| 2,706,634 | A * | 4/1955 | Valkenburg | 273/406 |
| 3,392,980 | A | 7/1968 | Ortega | |
| 3,519,272 | A * | 7/1970 | Vogelaere | 273/404 |
| 3,914,879 | A | 10/1975 | Taylor et al. | |
| 4,119,317 | A * | 10/1978 | Ohlund et al. | 273/406 |
| 4,222,564 | A | 9/1980 | Allen et al. | |
| 4,232,867 | A | 11/1980 | Tate, Sr. | |
| 4,288,080 | A | 9/1981 | Laporte et al. | |
| 4,540,182 | A | 9/1985 | Clement | |
| 4,553,757 | A * | 11/1985 | Keeney | 273/369 |
| 4,911,453 | A | 3/1990 | Essex et al. | |
| 5,169,157 | A * | 12/1992 | Salmon | 273/407 |
| 5,350,180 | A | 9/1994 | Adcock | |
| 5,403,017 | A | 4/1995 | Doss et al. | |
| 5,433,451 | A * | 7/1995 | De Vries | 273/392 |
| 5,695,196 | A | 12/1997 | Yanosky | |
| 5,865,439 | A * | 2/1999 | Marcuson et al. | 273/406 |
| 5,934,678 | A | 8/1999 | Theissen | |
| 2002/0158413 | A1 | 10/2002 | Dehart | |
| 2003/0168813 | A1 | 9/2003 | Wilkus | |
| 2008/0265511 | A1 | 10/2008 | Shum | |
| 2009/0179382 | A1 * | 7/2009 | Stincelli et al. | 273/392 |

FOREIGN PATENT DOCUMENTS

| | | | |
|---|---|---|---|
| CN | 2648387 | Y | 10/2004 |
| CN | 2896201 | Y | 5/2007 |
| DE | 102 19 314 | A1 | 11/2003 |
| GB | 2 399 160 | A | 9/2004 |

* cited by examiner

*Primary Examiner* — Mark S Graham
(74) *Attorney, Agent, or Firm* — Leydig, Voit & Mayer, Ltd.

(57) ABSTRACT

A target apparatus including a portable case; a target; and a drive contained within the portable case, the drive having a drive shaft accessible through an access opening in a side of the portable case. When the target is connected to the drive shaft for rotation relative to the portable case, the portable case provides stable support to the target apparatus.

10 Claims, 14 Drawing Sheets

Functional Block Diagram

Shooting Target Apparatus

Remote Controller

TARGET APPARATUS

FIELD OF THE INVENTION

The present invention relates to target apparatuses, and more particularly, to target apparatuses for use as shooting targets for firearms such as handguns and rifles. Although the invention will be described with reference with this particular use, it will be appreciated that the invention is not limited to such use.

BACKGROUND OF THE INVENTION

Previous target apparatuses include those found on traditional shooting ranges. These target apparatuses, however, are permanently installed and are typically large-scale installations. Therefore, they are limited in terms of the types of locations and environments they provide for shooters, and the possible arrangements of targets available.

Other smaller target apparatuses have similar limitations. These typically include cumbersome frames to provide sufficient stability during use. The frames usually require assembly before use and disassembly after use, and need adjustment depending on the surface on which they are located. Thus, these types of target apparatuses are difficult to transport and deploy in the field, thereby limiting the types of locations and environments in which they can be installed, and the possible arrangements of targets available.

One example includes a main box to house a drive and control equipment. A target and target holder are attached to a shaft from the drive that extends from a side of the main box. Legs in the form of long metal bars extend horizontally from the main box to respective adjustable feet that contact the ground. After use, the target holder and legs need to be disassembled from the main box before the target apparatus can be transported or stored efficiently. The main box, target holder and legs are transported or stored separately, which requires more handling during transport with the risk that particular components of the target apparatus may become separated, damaged or lost.

It is an object of the present invention to overcome or ameliorate at least one of the disadvantages of the prior art, or to provide a useful alternative.

SUMMARY OF THE INVENTION

The present invention provides a target apparatus including a portable case; and a drive contained within the portable case, the drive having a drive shaft accessible through an access opening in a side of the portable case such that a target is connectable to the drive shaft for rotation relative to the portable case, the portable case providing stable support to the target when the target apparatus is in use.

Preferably, the portable case is openable and securely reclosable, and includes a storage space for storing components of the target apparatus such that the target apparatus is a self-contained portable case when not in use.

Preferably, the target apparatus includes a target holder for holding the target, the target holder being connectable to the drive shaft for rotating the target relative to the portable case, and being one of the components storable in the storage space.

Preferably, the portable case can be oriented in at least two orientations, including a first orientation wherein the drive shaft is substantially vertical such that the target is rotatable about a vertical axis, and a second orientation wherein the drive shaft is substantially horizontal such that the target is rotatable about a horizontal axis.

Preferably, the target has a substantially planar targeting face and is rotatable between: a revealed position in which the targeting face is substantially perpendicular to a line of sight, and thereby viewable, from a shooting position; and a concealed position in which the targeting face is substantially parallel to the line of sight, and thereby not viewable, from the shooting position; whereby, in the first orientation, the targeting face is substantially vertical in both the revealed and concealed positions, and in the second orientation, the targeting face is substantially vertical in the revealed position and substantially horizontal in the concealed position.

Preferably, the portable case has dimensions and a mass such that when the portable case is placed freely on the ground, the portable case provides stable support to the target minimising movement of the target apparatus when in use.

In one embodiment, the drive shaft is contained wholly within the portable case, the side of the portable case with the access opening thereby maintaining a substantially flat profile to facilitate storage of the target apparatus or stacking of a plurality of the target apparatuses.

In another embodiment, the drive shaft projects through the access opening beyond the side of the portable case, the target apparatus including a protective collar mounted onto the side of the portable case around the access opening and projecting from the side of the portable case at least as far outwardly as the drive shaft, thereby providing protection to the drive shaft.

Preferably, the drive includes a drive controller and a motor, the drive controller controlling the motor to rotate the drive shaft in response to user commands. More preferably, the drive controller receives wireless command signals, and the target apparatus includes a remote controller for receiving user commands and transmitting corresponding wireless command signals for receipt by the drive controller.

Preferably, the drive controller can receive wireless command signals on a plurality of channels, and the drive controller includes a channel selection switch for selecting one of the channels on which to receive wireless command signals. Also preferably, the remote controller can transmit wireless command signals on a plurality of channels, and the remote controller includes a channel selection switch for selecting one of the channels on which to transmit wireless command signals.

Preferably, the remote controller includes a PID sensor for detecting motion in the vicinity of the remote controller such that, when motion is detected, corresponding wireless command signals can be transmitted for receipt by the drive controller.

Preferably, the drive includes two position sensors for detecting two respective rotational positions of the drive shaft and transmitting corresponding signals to the drive controller. More preferably, the position sensors are Hall sensors.

BRIEF DESCRIPTION OF THE FIGURES

Preferred embodiments in accordance with the best mode of the invention will now be described, by way of example only, with reference to the accompanying figures, in which.

DETAILED DESCRIPTION OF THE BEST MODE OF THE INVENTION

Figure 1:
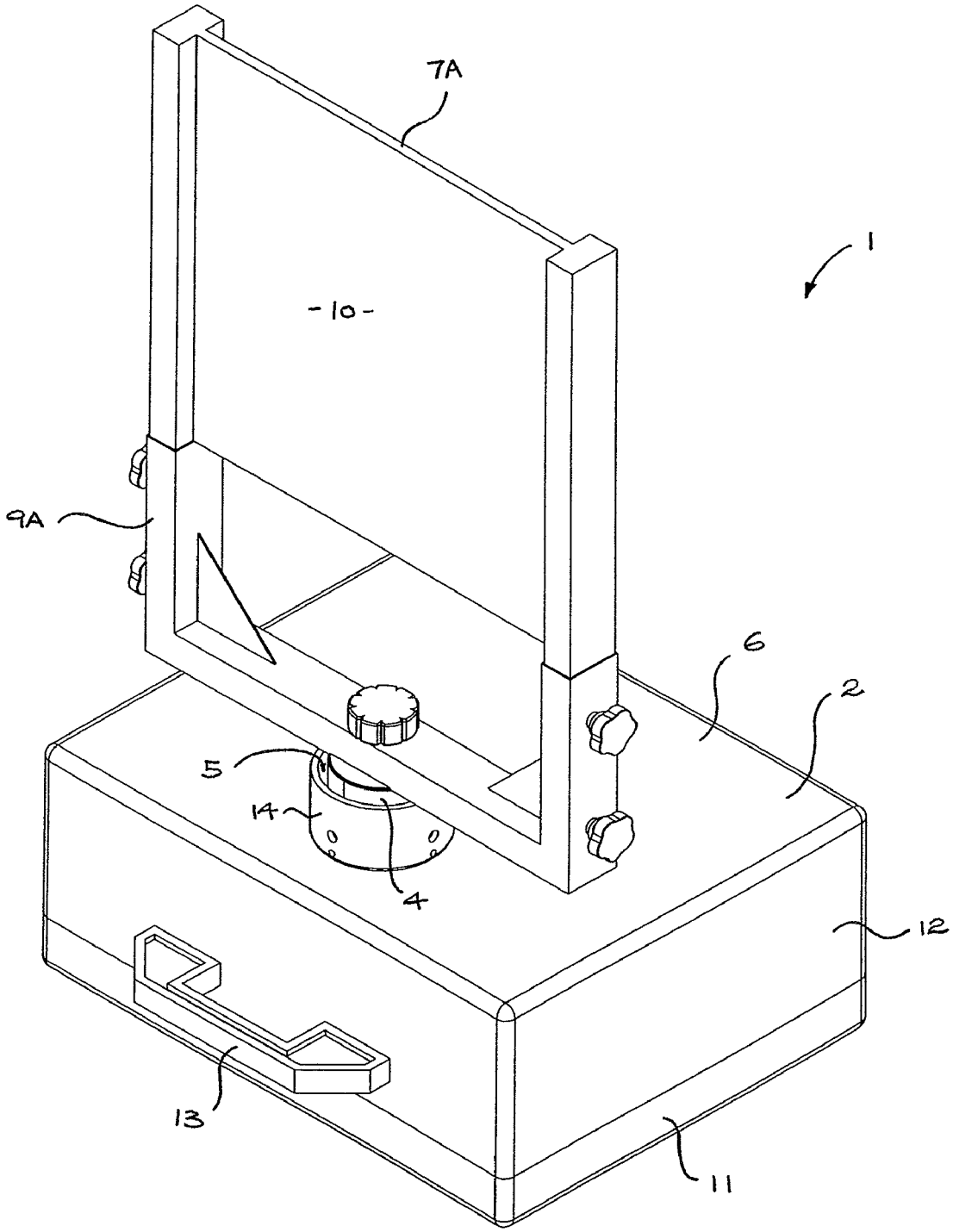
FIG. 1 is a perspective view of a target apparatus in accordance with the invention, shown in the first orientation with a first target in the revealed position.

Referring to the figures, the target apparatus 1 includes a portable case 2 and a drive 3 contained within the portable case. The drive 3 has a drive shaft 4 accessible through an access opening 5 in a side 6 of the portable case 2 such that a target 7A or 7B is connectable to the drive shaft for rotation relative to the portable case. The portable case 2 provides stable support to each target 7A and 7B when the target apparatus 1 is in use.

Figure 7:
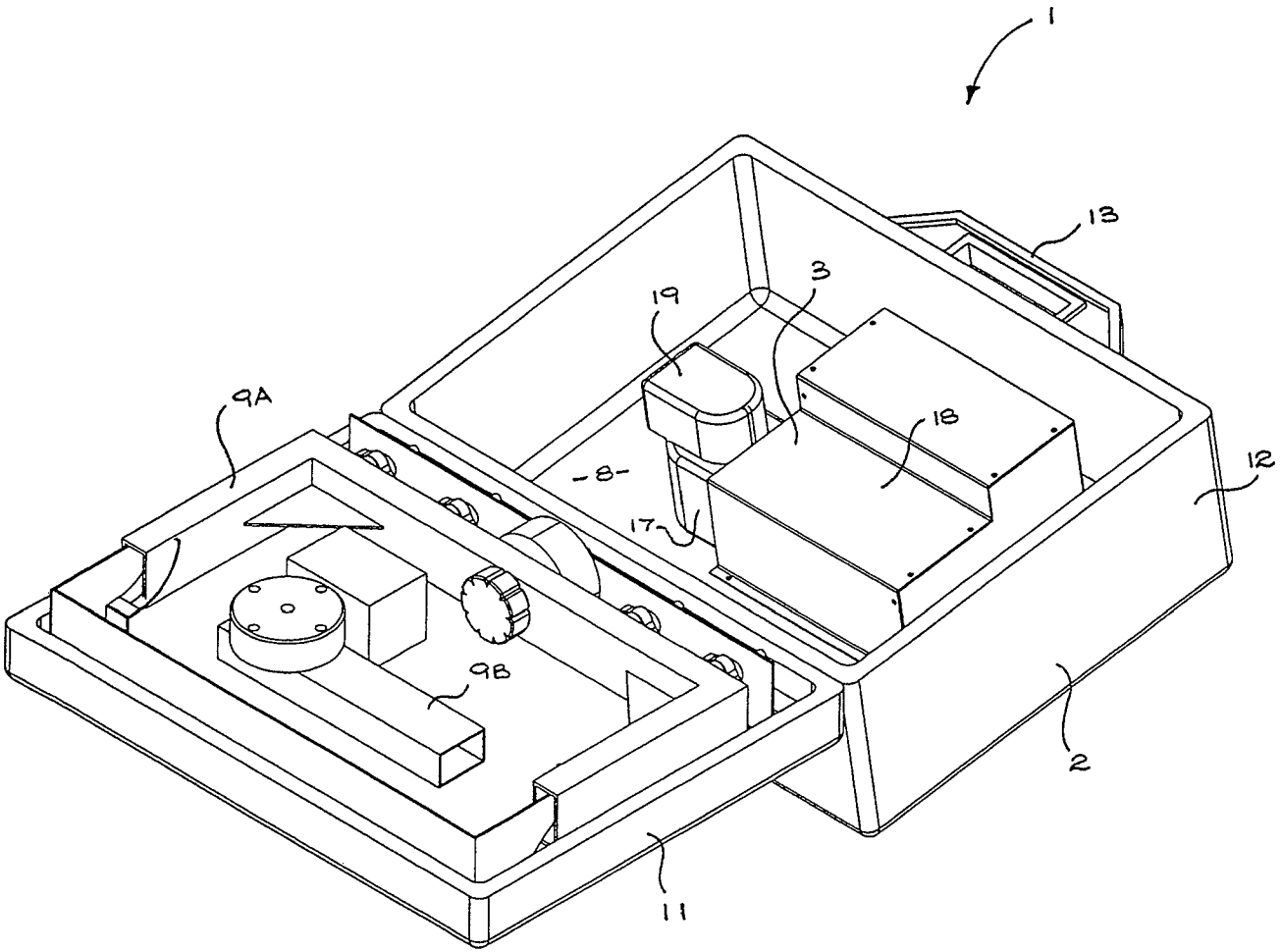
FIG. 7 is a perspective view of the target apparatus of FIG. 1, showing the portable case of the target apparatus in an open configuration, with components of the target apparatus stored inside the portable case in view.
Figure 8:
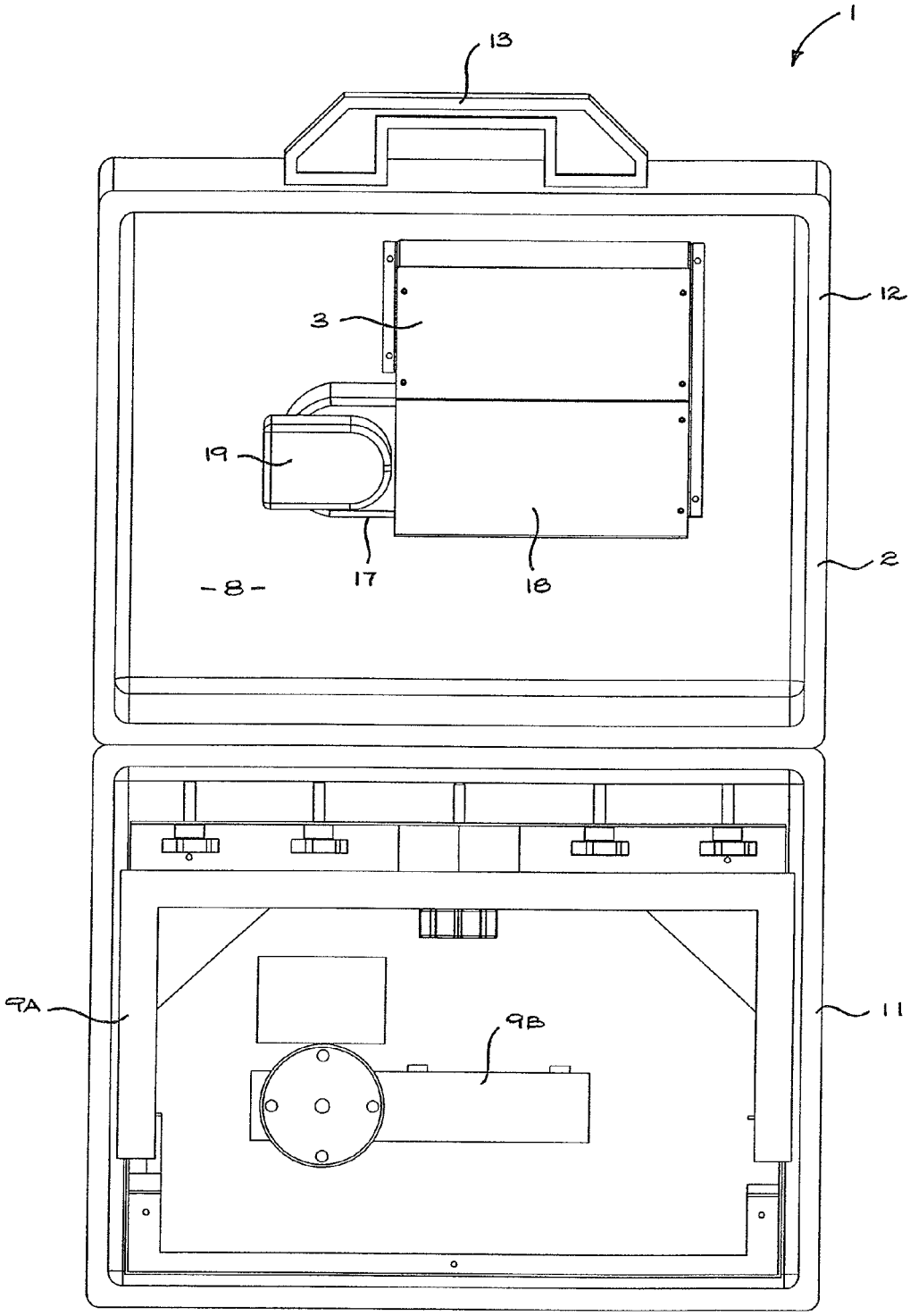
FIG. 8 is a top view of the target apparatus of FIG. 7.
Figure 9:
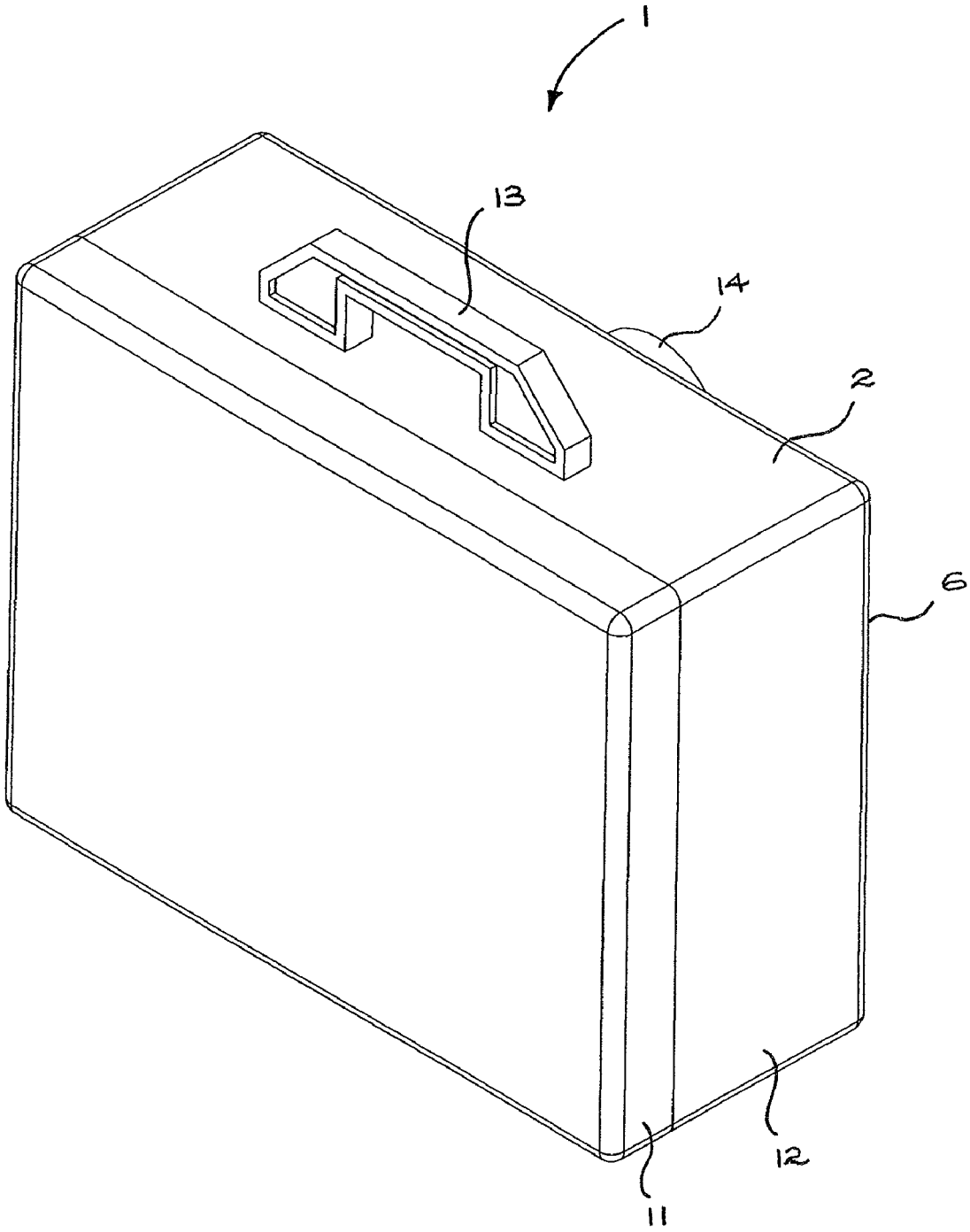
FIG. 9 is a perspective view of the target apparatus of FIG. 1, showing the portable case of the target apparatus in a closed configuration.
Figure 10:
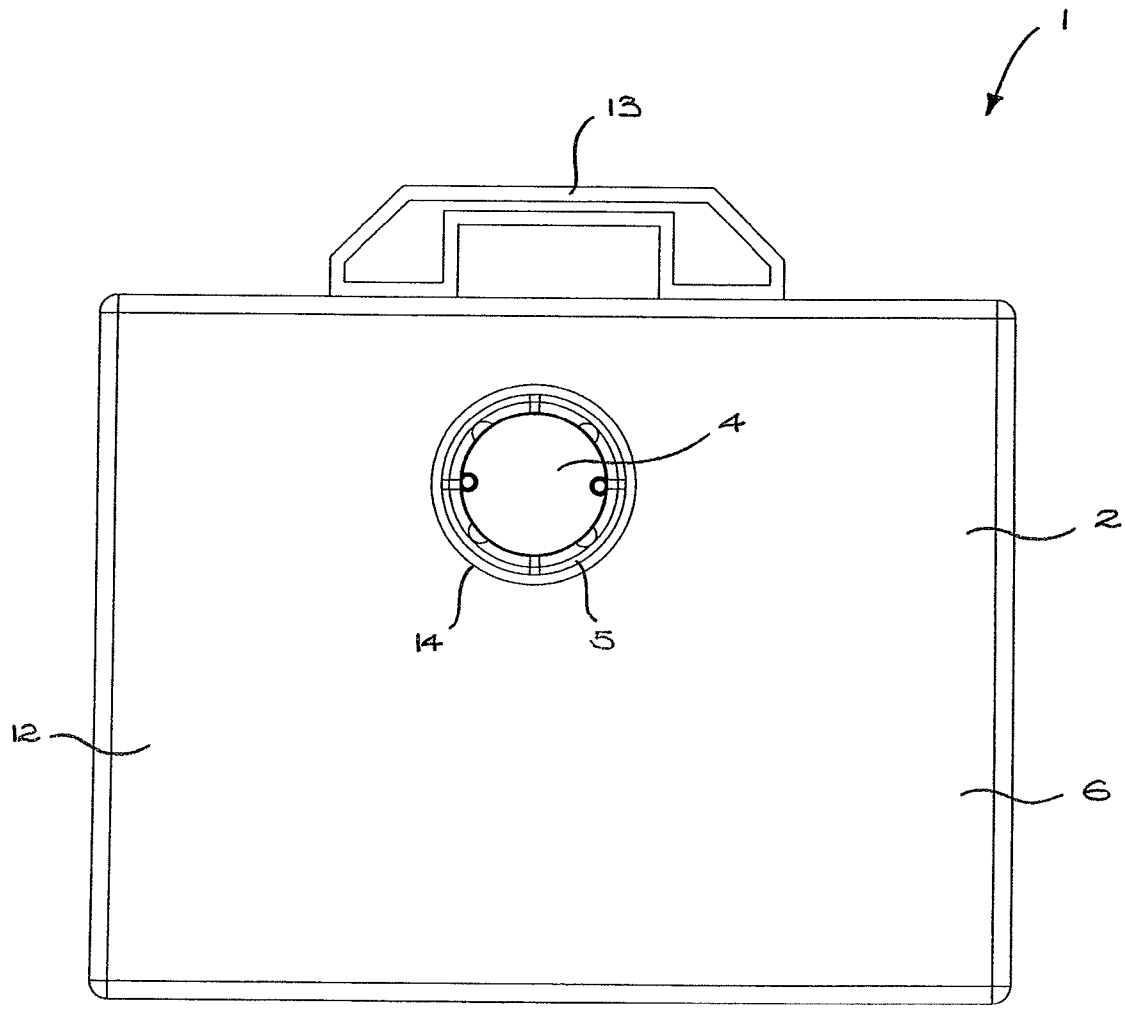
FIG. 10 is a side view of the target apparatus of FIG. 9, showing the access opening and the drive shaft.

The portable case 2 is openable and securely reclosable, and includes a storage space 8 for storing components of the target apparatus 1 such that the target apparatus is a self-contained portable case when not in use. In the present embodiment, the target apparatus 1 includes two target holders 9A and 9B for holding targets 7A and 7B respectively, the target holders being two of the components storable in the storage space 8, as best shown in FIGS. 7 and 8. Each target holder 9A and 9B is connectable to the drive shaft 4 for rotating respective targets 7A and 7B relative to the portable case 2. As best shown in FIGS. 1, 3, 4 and 6, each target 7A and 7B can be a replaceable target that can be removed from the target holders 9A and 9B once each target has been shot and then replaced by another replaceable target for the next set of shots.

Figure 4:
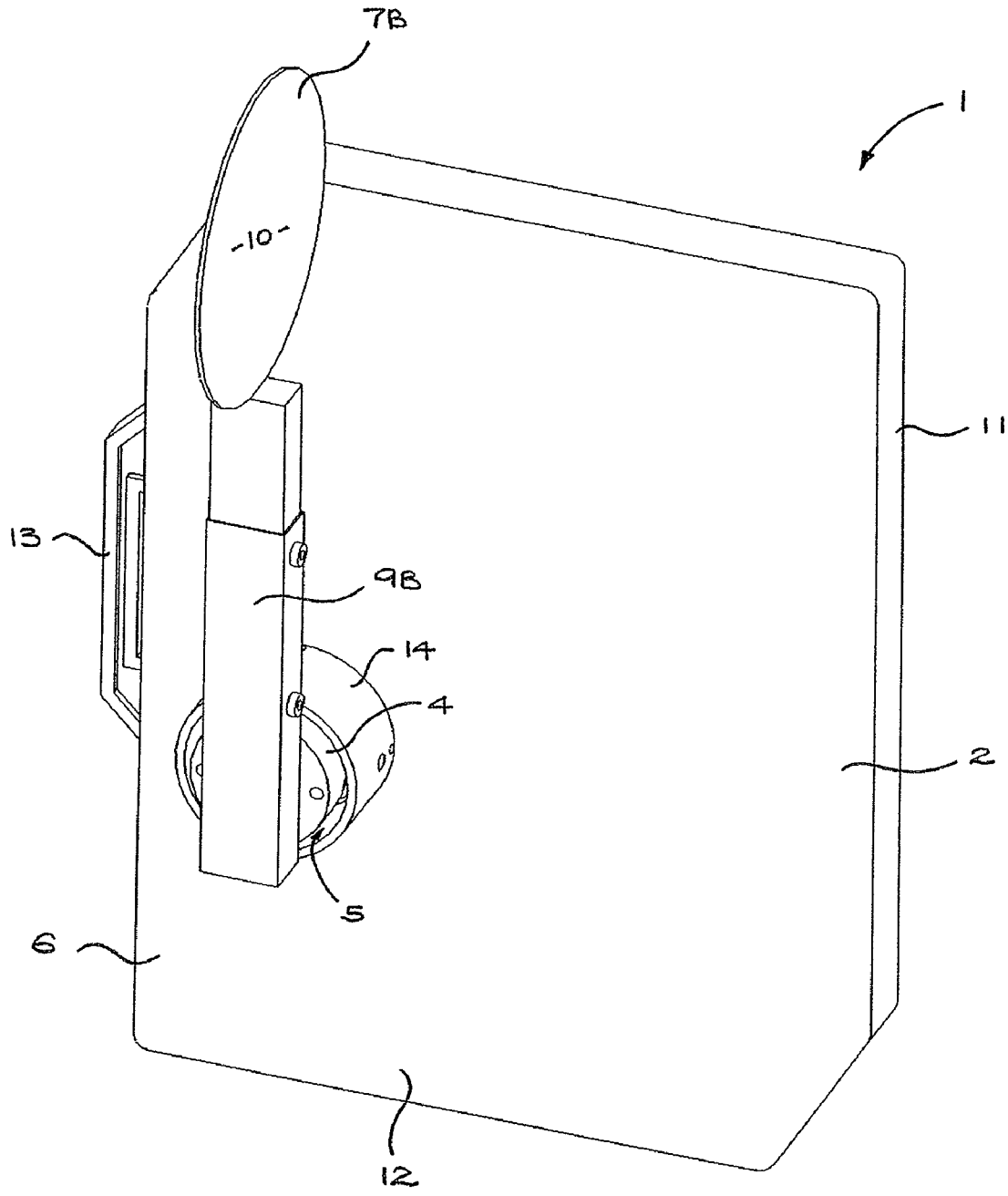
FIG. 4 is a perspective view of the target apparatus of FIG. 1, shown in the second orientation with a second target in the revealed position.

The portable case 2 can be oriented in at least two orientations, including a first orientation, as best shown in FIG. 1, wherein the drive shaft 4 is substantially vertical such that the target 7A is rotatable about a vertical axis, and a second orientation, as best shown in FIG. 4, wherein the drive shaft 4 is substantially horizontal such that the target 7B is rotatable about a horizontal axis.

Figure 2:
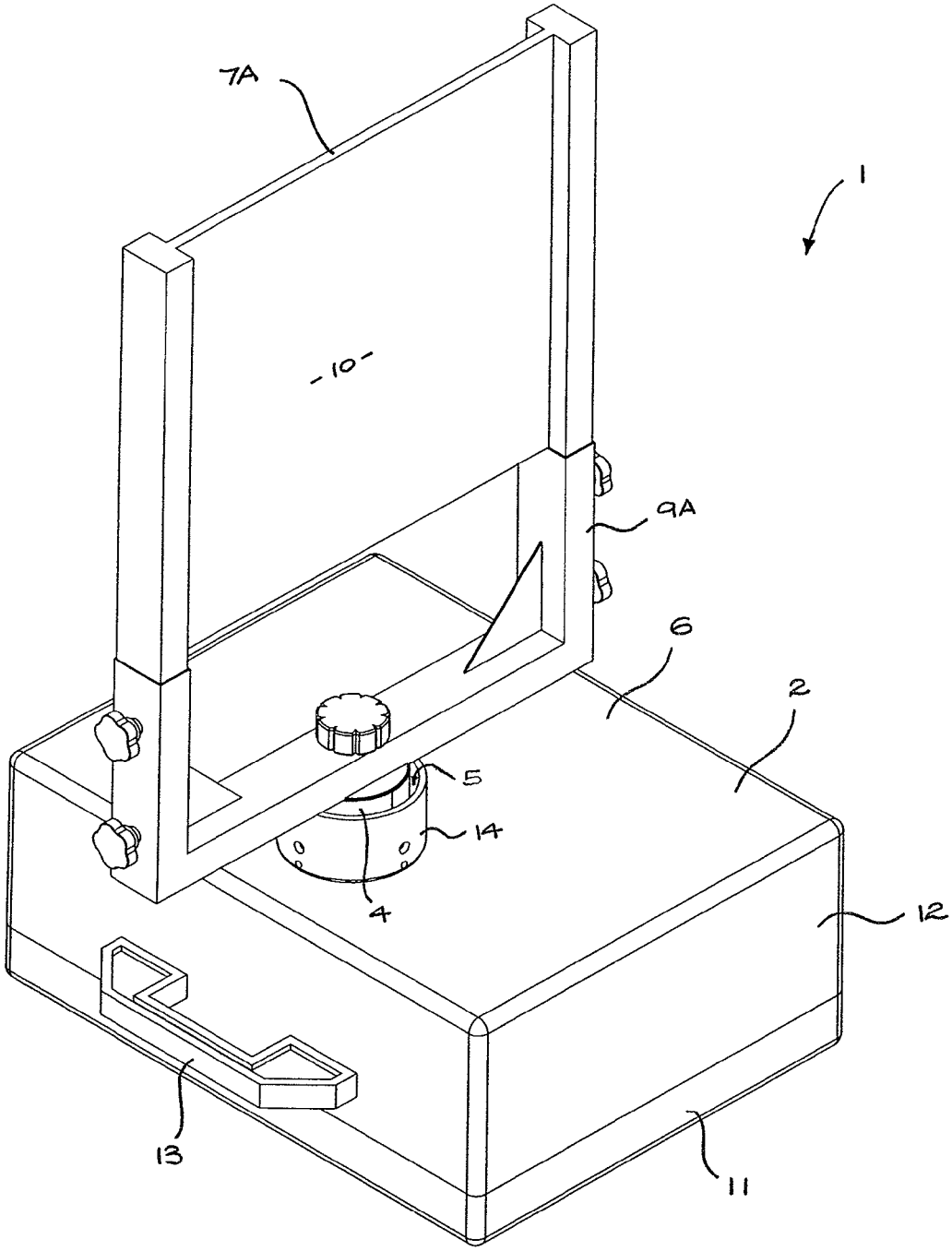
FIG. 2 is a perspective view of the target apparatus of FIG. 1, shown with the target in the concealed position.
Figure 3:
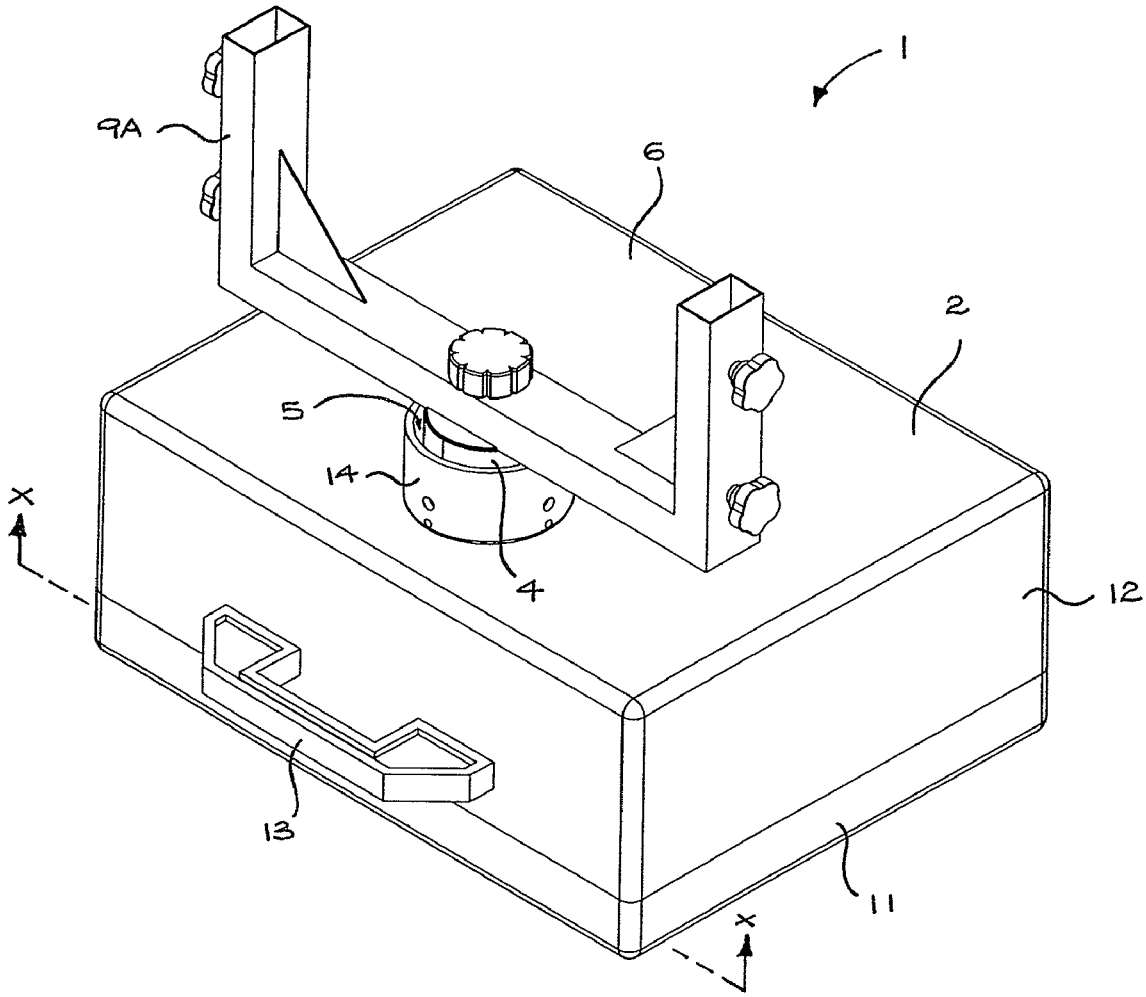
FIG. 3 is a perspective view of the target apparatus of FIG. 1, shown with the target removed.
Figure 5:
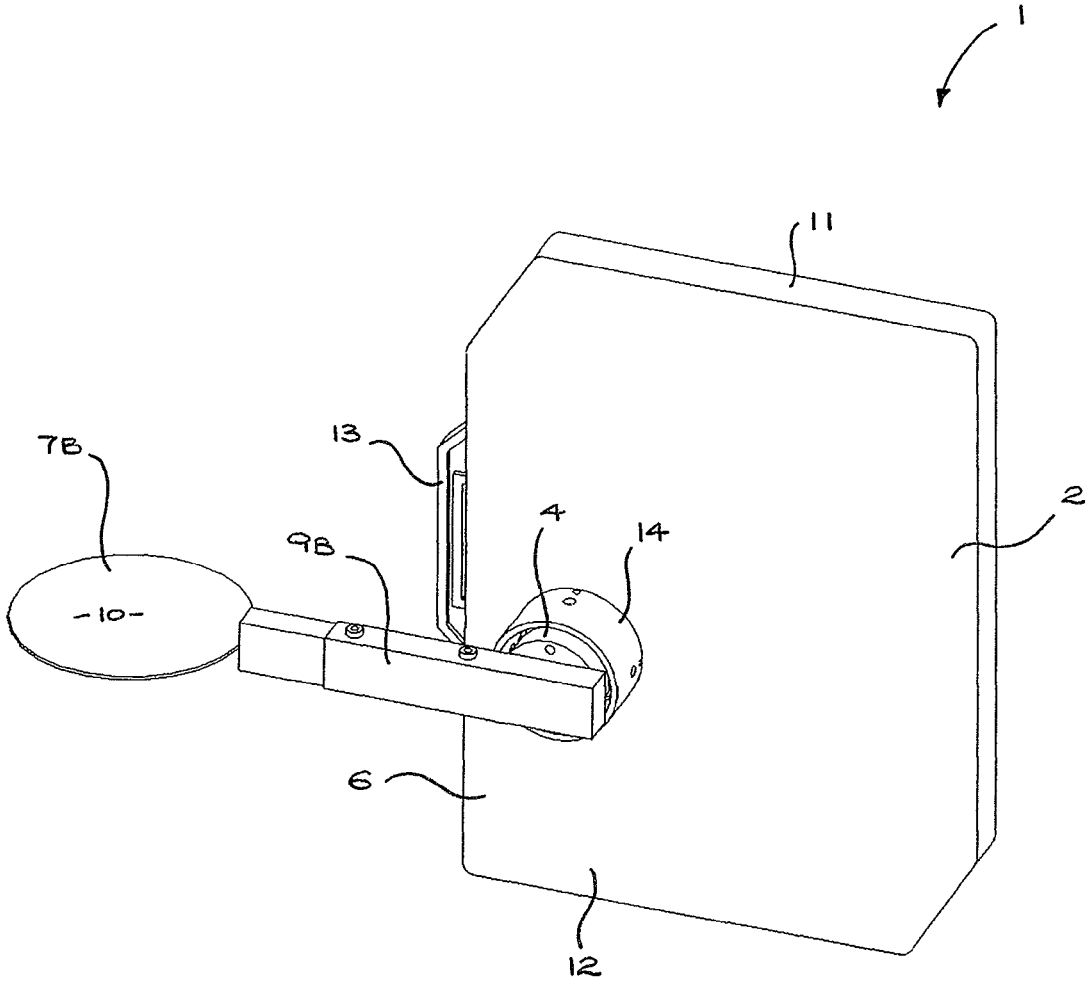
FIG. 5 is a perspective view of the target apparatus of FIG. 4, shown with the target in the concealed position.
Figure 6:
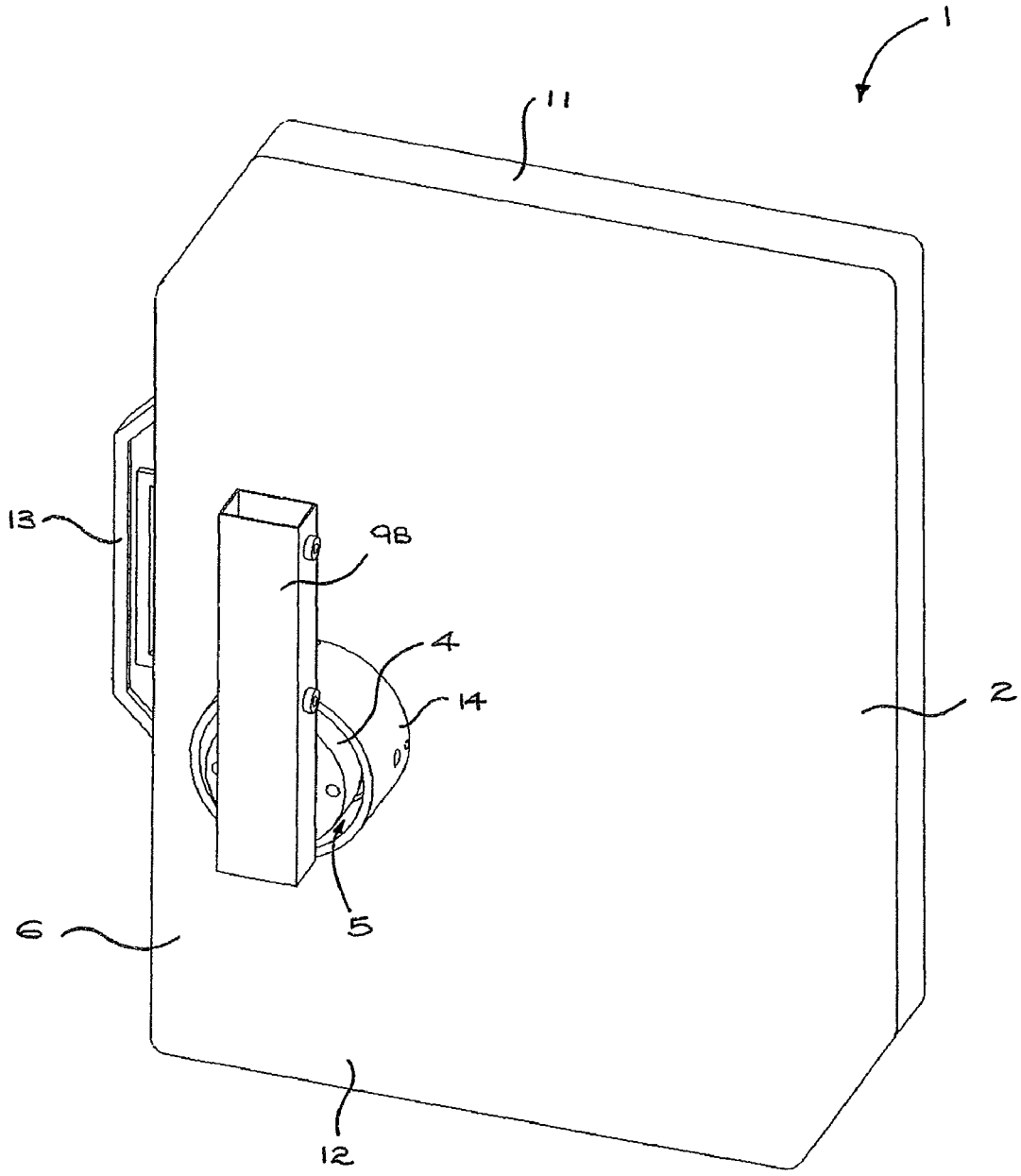
FIG. 6 is a perspective view of the target apparatus of FIG. 4, shown with the target removed.

In the present embodiment, each target 7A and 7B has a substantially planar targeting face 10 and is rotatable between a revealed position, as best shown in FIGS. 1 and 4, and a concealed position, as best shown in FIGS. 2 and 5. In the revealed position, the targeting face 10 is substantially perpendicular to a line of sight, and thereby viewable, from a shooting position. In the concealed position, the targeting face 10 is substantially parallel to the line of sight, and thereby not viewable, from the shooting position. In the first orientation, the targeting face is substantially vertical in both the revealed and concealed positions, as best shown in FIGS. 1 and 2. In the second orientation, the targeting face 10 is substantially vertical in the revealed position and substantially horizontal in the concealed position, as best shown in FIGS. 4 and 5 respectively.

The portable case 2 has dimensions and a mass such that when the portable case 2 is placed freely on the ground, in any orientation, the portable case 2 provides stable support to each target 7A and 7B minimising movement of the target apparatus 1 when in use. The types of firearms and ammunition used to hit the targets 7A and 7B are also taken into account when specifying the dimensions and mass of the portable case 2 to ensure that sufficiently stable support is provided. This allows the target apparatus 1 to be used on a variety of surfaces, including rough and uneven surfaces, whilst still providing stable support. More particularly, the stable support provided by the portable case minimises movement before, during and after a target is shot. This is important since any movement before a target is shot may alert a shooter to the presence of the target, detracting from the value the target apparatus provides for training shooters. Stability when a target is shot and afterwards during recoil is also important to ensure that the target apparatus does not fall over.

Thus, in addition to traditional shooting ranges, the target apparatus of the present invention can be employed in the field, in any environment, including forests, bushland, mountain terrain and snowfields, thereby providing very realistic simulations of shooting situations.

In the present embodiment, the portable case 2 has a form similar to a large suitcase, which is generally in the shape of a rectangular prism. The portable case 2 has a hinged lid 11 which can be closed and locked onto a main body 12 of the portable case. The main body 12 also has a handle 13 for manual handling of the portable case 2.

In one variation, the drive shaft 4 is contained wholly within the portable case 2. The side 6 of the portable case 2 with the access opening 5 thereby maintains a substantially flat profile to facilitate storage of the target apparatus 1 or stacking of a plurality of the target apparatuses.

Figure 11:
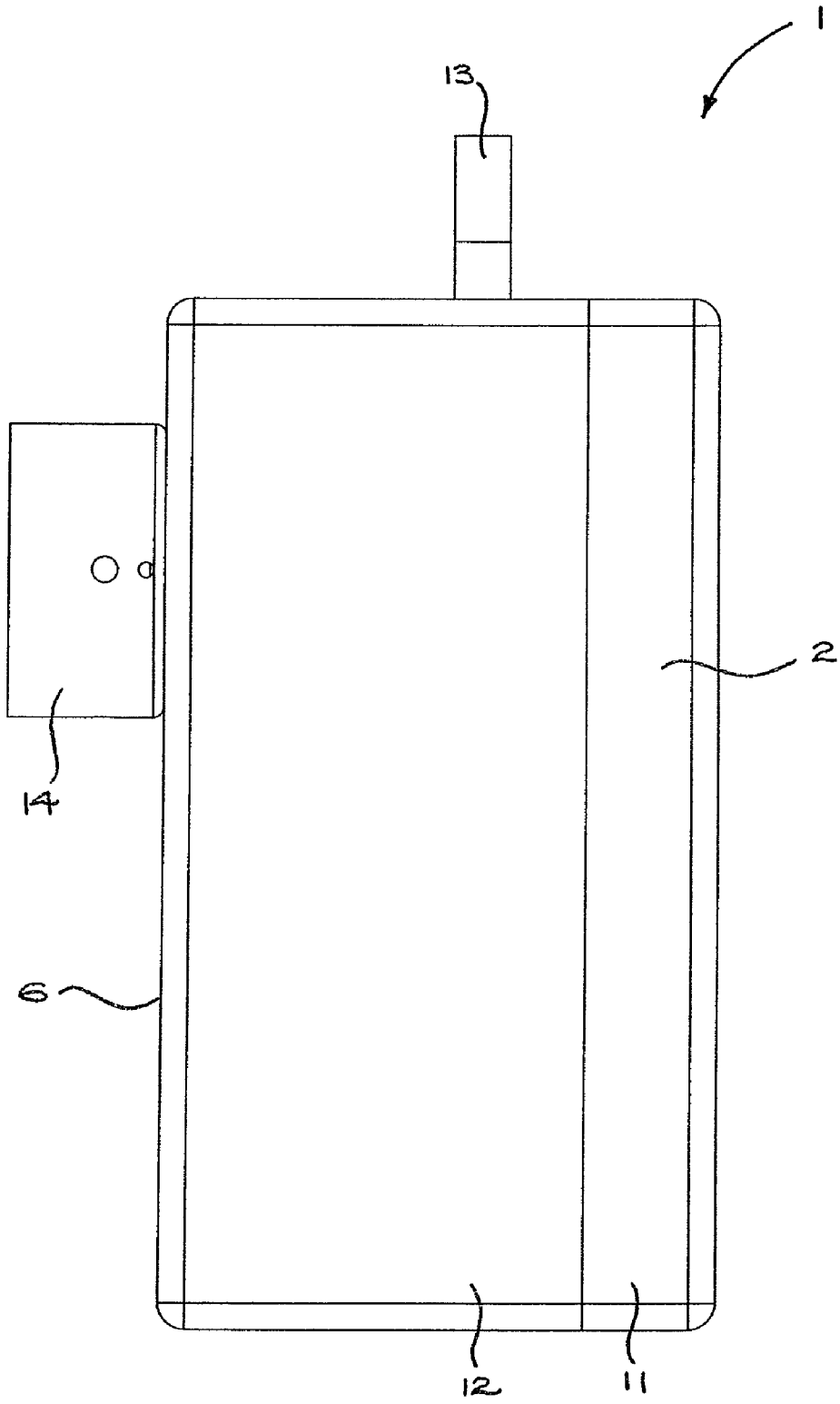
FIG. 11 is an end view of the target apparatus of FIG. 9, showing the protective collar surrounding the drive shaft and projecting from the side of the portable case.
Figure 12:
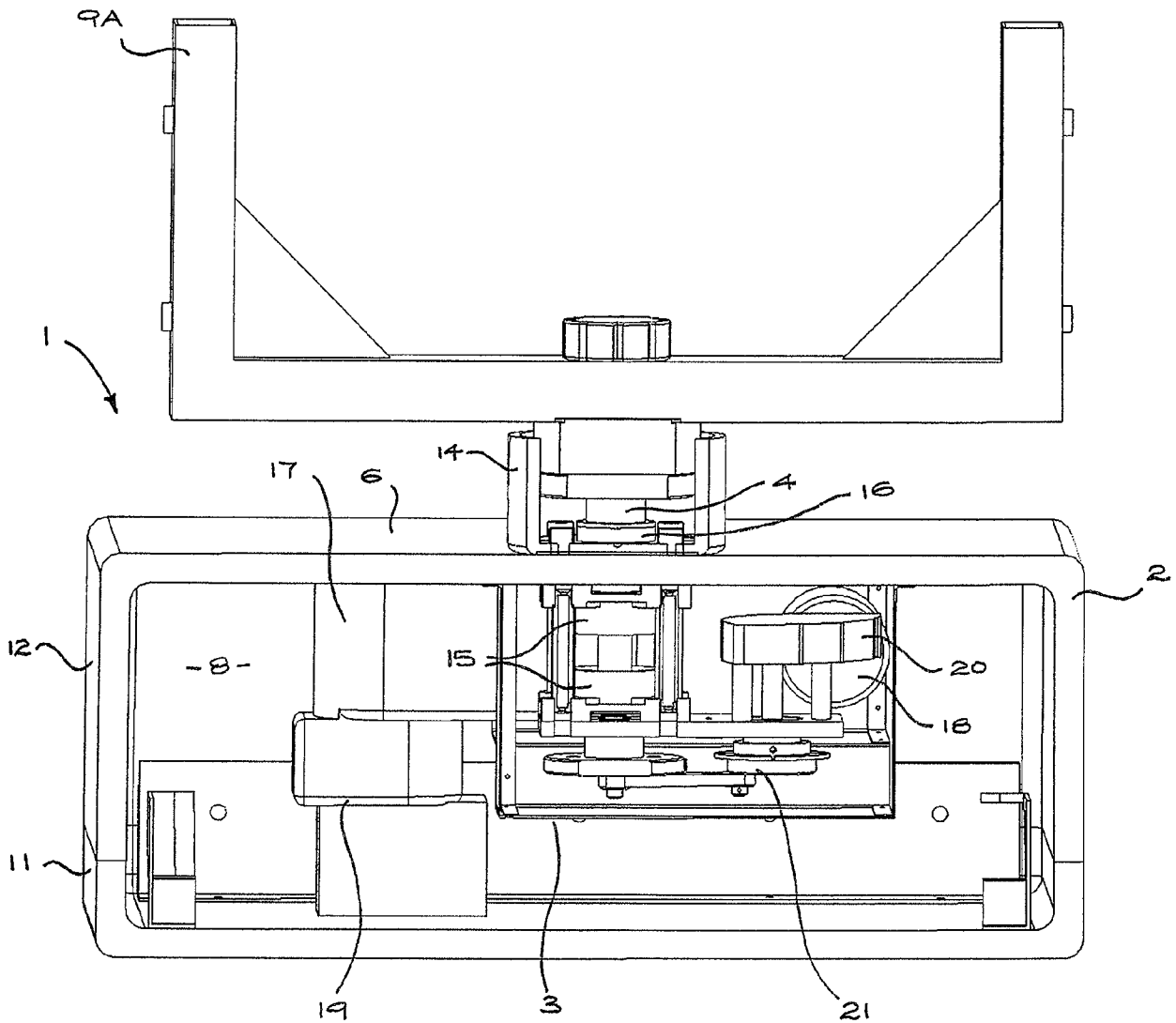
FIG. 12 is a cross-sectional view of the target apparatus of FIG. 3 taken along section line X-X.
Figure 13:
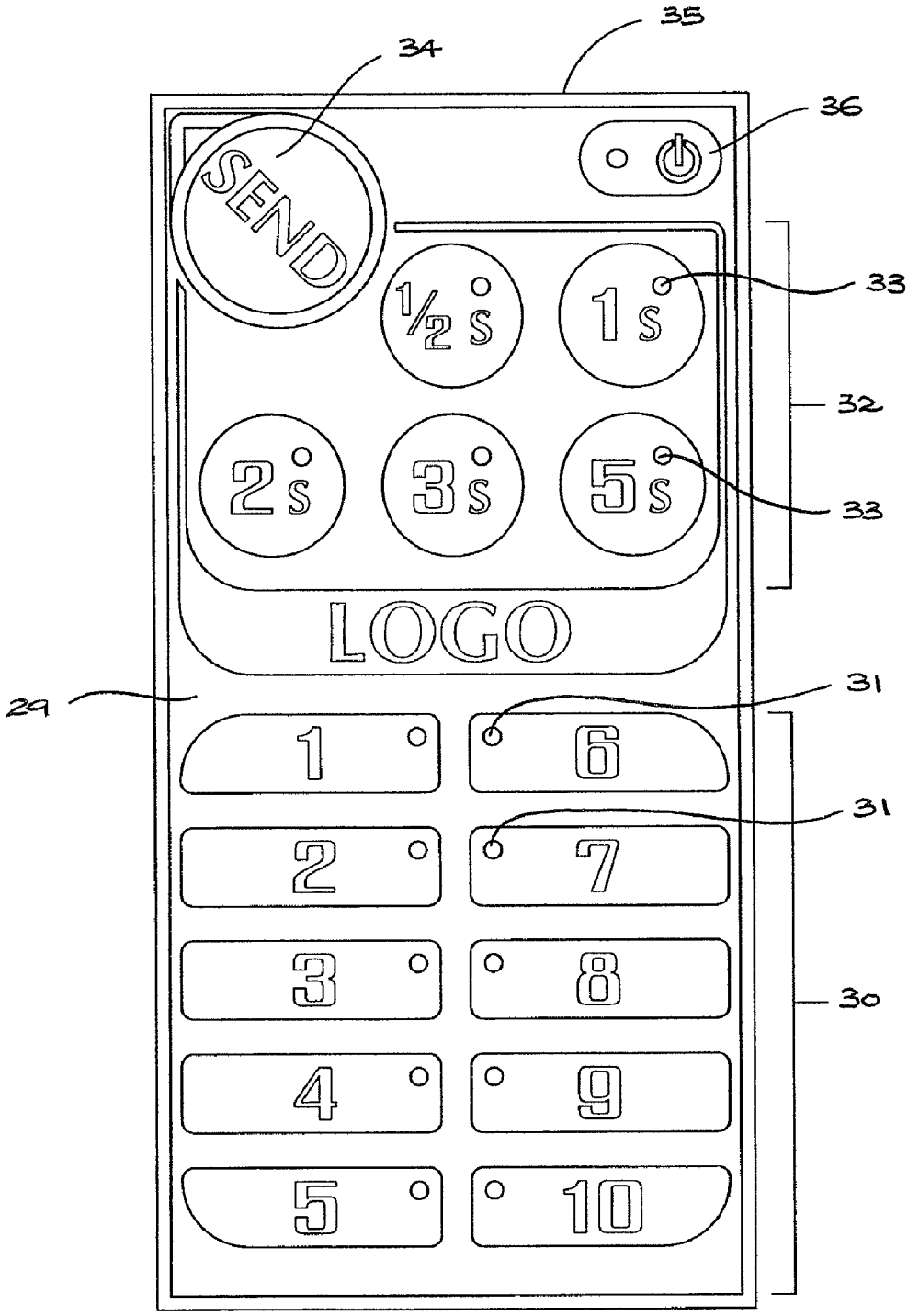
FIG. 13 is a perspective view of the remote controller included with the target apparatus for remotely controlling the drive controller.
Figure 15:
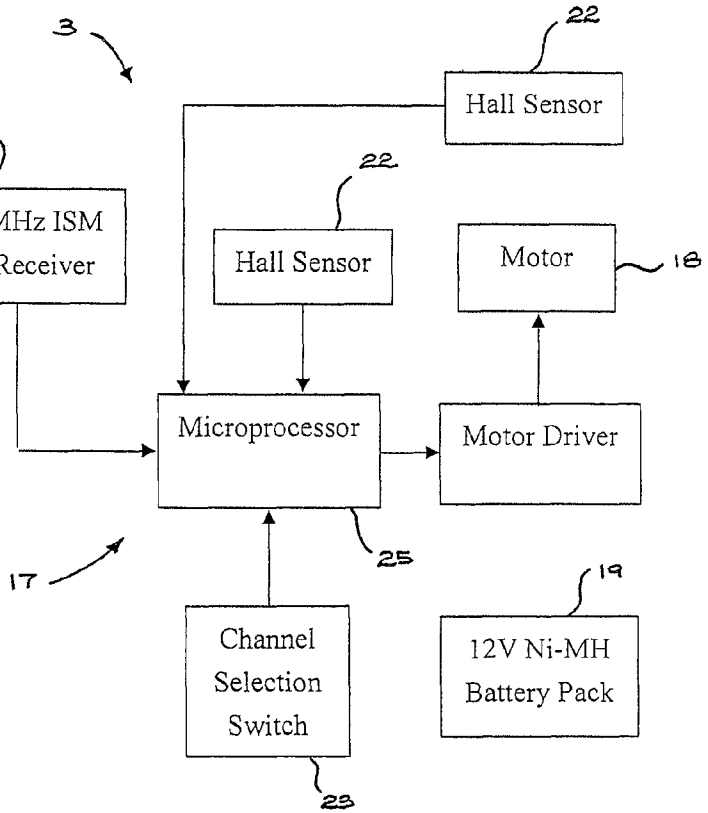
FIG. 15 is a functional block diagram of the drive of the target apparatus of FIG. 1, showing the various parts of the drive and the interaction between the parts.
Figure 14:
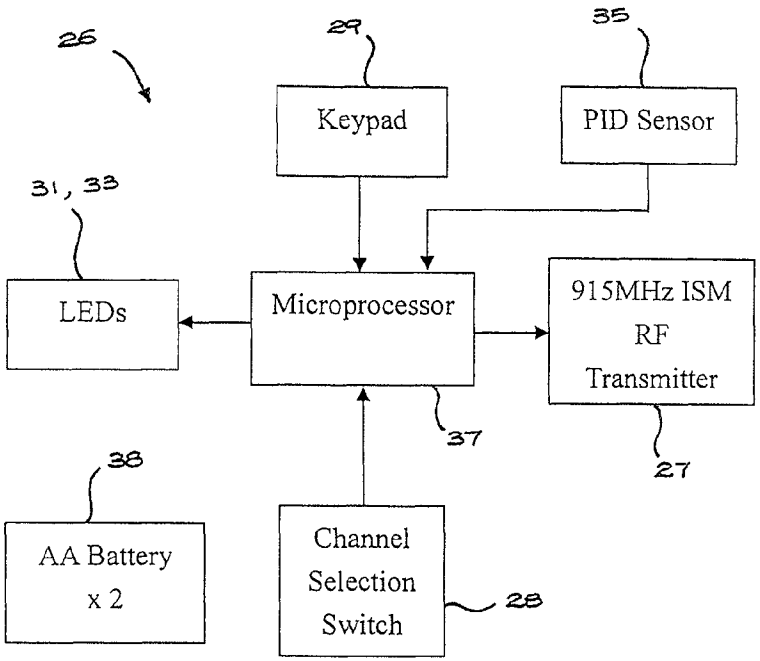
FIG. 14 is a functional block diagram of the remote controller of FIG. 13, showing the various parts of the remote controller and the interaction between the parts.

In the present variation, the drive shaft 4 projects through the access opening 5 beyond the side 6 of the portable case 2. The target apparatus 1 further includes a protective collar 14 mounted onto the side 6 of the portable case 2 around the access opening 5. As best shown in FIG. 11, the protective collar 14 projects from the side 6 of the portable case 2 at least as far outwardly as the drive shaft 4, thereby providing protection to the drive shaft. The drive 3 also includes a pair of rotary bearing assemblies 15 around the drive shaft 4 to provide support to the drive shaft. There is also an O-ring 16 around the drive shaft at the access opening 5 to seal the access opening against the ingress of contaminants such as dust and moisture.

The drive 3 further includes a drive controller 17 and a motor 18, the drive controller controlling the motor to rotate the drive shaft 4 in response to user commands. The drive 3 includes a battery pack 19 to power the motor 18, which is an electric DC motor in the present embodiment. The battery pack 19 is a 12 V Ni-MH battery pack, similar to those used in cars. However, other types of battery packs can be used in other embodiments, depending on the particular design requirements. A gear box 20 is also provided with the drive 3 to apply appropriate gearing to the motor output in order to provide a suitable rotational speed to the drive shaft 4 via a pulley and belt arrangement 21.

In the present embodiment, the drive controller 17 controls the motor 18 to rotate the drive shaft 4 between two positions displaced 90° from one another, corresponding to the revealed and concealed positions of the targets as described above. To facilitate this, the drive 3 includes two position sensors 22 for detecting two respective rotational positions of the drive shaft, those being the revealed and concealed positions described above for the present embodiment, and transmitting corresponding signals to the drive controller 17. Preferably, the position sensors are Hall sensors, but other position sensors, such as reed switches, optical sensors or magnetic detectors, can be utilised.

Also in the present embodiment, the drive controller 17 receives wireless command signals to control the motor 18. Preferably, the drive controller 17 can receive wireless command signals on a plurality of channels, and includes a channel selection switch 23 for selecting one of the channels on which to receive wireless command signals. In particular, the drive controller 17 includes a wireless signal receiver 24 for receiving wireless command signals, which in the present embodiment, is a 915 MHz ISM RF receiver. In other embodiments, however, other types of wireless signal receivers or transceivers can be used. The drive controller 17 further includes a microprocessor 25 to process data received from the various components of the drive controller and to issue instructions to those components.

The target apparatus 1 further includes a remote controller 26 for receiving user commands and transmitting corresponding wireless command signals via a wireless signal transmitter 27 for receipt by the drive controller 17, and specifically, the wireless signal receiver 24. In the present embodiment, the wireless signal transmitter 27 is a 915 MHz ISM RF transmitter. In other embodiments, however, other types of wireless signal transmitters or transceivers can be used. The remote controller 26 can transmit wireless command signals on a plurality of channels, and includes a channel selection switch 28 for selecting one of the channels on which to transmit wireless command signals. The remote controller 26 is powered by two AA size batteries 38 and includes a keypad 29 for receiving user commands. However, other means for powering the remote controller and for receiving user commands, such as touch sensitive screens, can be employed.

In the present embodiment, the remote controller 26 can transmit wireless command signals to a plurality of drive controllers 17, each in a separate respective portable case 2 so that a plurality of targets 7A or 7B can be located in a shooting area. The remote controller 26 includes a plurality of selector buttons 30, each corresponding to a respective one of the drive controllers 17. LEDs 31 correspond to each selector button 30 to indicate when one of the selector buttons has been pressed by a user in order to select the drive controller 17 corresponding to that selector button. Time delay buttons 32 are also included to allow the user to nominate the time delay before a selected drive controller 17 moves a corresponding target 7A or 7B from a concealed position to a revealed position, as described above. Further LEDs 33 correspond to each time delay button to indicate when one of the time delay buttons has been pressed by the user.

A send button 34 is included on the remote controller 26, which when pressed by the user, causes the remote controller to transmit commands or settings selected by the user, such as the nominated time delay, thereby allowing the user to select precisely when commands are issued. A PID sensor 35 is also included on the remote controller 26 for detecting motion in the vicinity of the remote controller such that, when motion is detected, corresponding wireless command signals can be transmitted for receipt by the drive controller 17. This can be used, for example, to detect the presence of a shooter and then send command signals to move the target 7A or 7B into a revealed position. The remote controller 26 has an on/off switch 36 to turn the remote controller on or off. As well as saving battery power when the remote controller is not needed, turning off the remote controller also safeguards against unintentional commands being transmitted. The remote controller 26 also has a microprocessor 37 to process data received from the various components of the remote controller and to issue instructions to those components.

However, other ways of controlling the operation of the drive controllers 17, including other combinations of buttons and other features for receiving user inputs, can be featured in other embodiments. For example, the drive controllers can be programmed to reveal and conceal targets in particular sequences, with the remote controller including other buttons or touch screen inputs to allow the user to set up programs, or start or finish preset programs. Furthermore, the channel selection switches 23 and 28, on the drive controllers 17 and the remote controller 26 respectively, allow multiple groups of drive controllers to be controlled on different channels by the same remote controller or different remote controllers. In addition to remote controllers, such as that described above, other controls can also be used to control the drive controllers 17. For example, a wired controller with functionality similar to the remote controller described above can be used. Buttons can also be provided on the portable case 2 or on the drive controllers 17 themselves, so that, for example, the user can preset programs before shooting practice begins.

In use, the target apparatus is transported to a desired shooting site. The lid 11 of the portable case 2 is then opened to allow the user to retrieve the desired target holder 9A or 9B from the storage space 8 inside the portable case. The portable case 2 is then closed securely and the desired target holder 9A or 9B is simply connected to the drive shaft 4. The portable case 2 is then positioned in the desired orientation at the desired shooting location. After a suitable target 7A or 7B is attached to the target holder 9A or 9B, the target apparatus 1 is ready for shooting by a shooter. The user then causes the target 7A or 7B to rotate from a concealed position to a revealed position at a desired time using the remote controller 26, or other controls, directly in real time or through a preset program, as described above.

The present invention provides many significant advantages over the prior art. The target apparatus of the present invention provides stable support to shooting targets before, during and after being shot on a wide variety of surfaces, including rough and uneven terrain, with a wide range of firearms and ammunition. The present target apparatus can be oriented in a plurality of orientations, thereby allowing targets to be concealed and revealed from a variety of positions. In particular, the target apparatus accommodates targets that rotate about vertical and horizontal axes of rotation.

The target apparatus of the present invention can be in the form of a self-contained portable case when not in use, so that the target apparatus can be easily transported and stored. In particular, the target apparatus includes a portable case, resembling a suitcase with a handle, which can store the components of the target apparatus, such as target holders and targets, when not in use, but performs the function of providing stability to the target when in use. The risk of particular components of the target apparatus becoming separated, damaged or lost during transportation and storage is minimised since the components are stored within the target apparatus itself.

Therefore, the present invention provides target apparatuses that are versatile, can be used in many shooting practice situations in a variety of environments, and that allow many different arrangements of targets, thereby providing realistic shooting simulations. Target apparatuses provided by the present invention are easy to transport, store and deploy in the field, with the components of each target apparatus being storable together in a single self-contained unit.

Although the invention has been described with reference to specific examples, it will be appreciated by those skilled in the art that the invention can be embodied in many other forms. It will also be appreciated by those skilled in the art that the features of the various examples described can be combined in many other combinations.

The invention claimed is:

1. A target apparatus comprising:

a prismatic portable case having walls and planar exterior surfaces, the portable case including a main body having a first internal volume, and a lid hingedly connected to the main body and having a second internal volume, the main body and the lid having an open position providing access to the first and second internal volumes and a closed position enclosing contents of the main body and the lid within the first and second internal volumes;

an electrically powered drive mechanism mounted to the main body within the first internal volume and including a rotatable drive shaft, rotating about an axis of rotation, the drive shaft being accessible from outside the portable case through an access opening in one of the walls of the portable case;

a first target holder releasably mountable on the drive shaft, outside the portable case, the first target holder including a pair of spaced-apart legs for receiving and holding a first target between the legs, the legs of the first target holder, when the first target holder is mounted on the drive shaft, revolving about an axis generally parallel to the axis of rotation of the drive shaft, and the lid, within the second volume, for storage and transportation of the first target holder with the portable case in the closed position; and a second target holder releasably mountable on the drive shaft outside the portable case, the second target holder including a leg for receiving and holding a second target at an end of leg, remote from the drive shaft when the second target holder is mounted on the drive shaft, the leg of the second target holder being transverse to the axis of rotation of the drive shaft when the second target holder is mounted on the drive shaft, and the lid, within the second volume, for storage and transportation of the second target holder with the portable case in the closed position.

2. The target apparatus according to claim 1, wherein the drive shaft is contained wholly within the first internal volume of main body.

3. The target apparatus according to claim 1, wherein the drive shaft projects through the access opening beyond the wall of the portable case including the access opening and outside of the portable case, and the target apparatus includes a protective collar mounted on the wall of the portable case including the access opening, outside of the portable case, and protecting the drive shaft.

4. The target apparatus according to claim 1, wherein the electrically powered drive mechanism includes a drive controller and an electrical motor, the drive controller controlling the motor to rotate the drive shaft in response to user commands.

5. The target apparatus according to claim 4, wherein the drive controller receives wireless command signals, and the target apparatus includes a remote controller for receiving user commands and transmitting corresponding wireless command signals for receipt by the drive controller.

6. The target apparatus according to claim 5, wherein the drive controller receives wireless command signals on a plurality of channels, and the drive controller includes a channel selection switch for selecting one of the channels for receiving the wireless command signals.

7. The target apparatus according to claim 5, wherein the remote controller transmits wireless command signals on a plurality of channels, and the remote controller includes a channel selection switch for selecting one of the channels for transmitting wireless command signals.

8. The target apparatus according to claim 5, wherein the remote controller includes a PID sensor detecting motion proximate the remote controller and, in response to detecting motion, transmitting wireless command signals to the drive controller.

9. The target apparatus according to claim 4, wherein the electrically powered drive mechanism includes two position sensors for detecting two respective rotational positions of the drive shaft and transmitting corresponding signals to the drive controller.

10. The target apparatus according to claim 9, wherein the position sensors are Hall sensors.

* * * * *